US005718654A

United States Patent [19]

Kennedy

[11] Patent Number: 5,718,654

[45] Date of Patent: Feb. 17, 1998

[54] WEIGHT LIFTING CABLE ATTACHMENT ALLOWING PRONATION AND SUPINATION OF THE HAND

[76] Inventor: Edward S. Kennedy, R.D. #9, Box 528, Greensburg, Pa. 15601

[21] Appl. No.: 727,360

[22] Filed: Oct. 8, 1996

[51] Int. Cl.[6] ..... A63B 23/035

[52] U.S. Cl. ..... 482/139; 482/102

[58] Field of Search ..... 482/92, 93, 99, 482/101–103, 106, 139; 384/508, 511

[56] References Cited

U.S. PATENT DOCUMENTS

| | | | |
|---|---|---|---|
| 1,333,005 | 3/1920 | Warner | 482/139 X |
| 2,143,091 | 2/1939 | Searles | 384/511 X |
| 3,384,370 | 5/1968 | Bailey . | |
| 4,629,184 | 12/1986 | Selkee . | |
| 4,690,400 | 9/1987 | Metz . | |
| 4,743,018 | 5/1988 | Eckler | 482/106 |
| 4,822,035 | 4/1989 | Jennings et al. . | |
| 5,273,509 | 12/1993 | Vittone . | |
| 5,407,405 | 4/1995 | Oren | 482/139 X |

FOREIGN PATENT DOCUMENTS

| | | | |
|---|---|---|---|
| 1643025 | 4/1991 | U.S.S.R. | 482/102 |

*Primary Examiner*—Richard J. Apley
*Assistant Examiner*—John Mulcahy
*Attorney, Agent, or Firm*—Clifford A. Poff

[57] ABSTRACT

An attachment for a cable-actuated weight lifting system, the attachment having inner and outer sections capable of pivot relative to each other through the use of bearings or a layer of polytetrafluoroethylene, such pivot allowing for supination and pronation of the hand of a user through a handle connected to the inner section.

14 Claims, 6 Drawing Sheets

WEIGHT LIFTING CABLE ATTACHMENT ALLOWING PRONATION AND SUPINATION OF THE HAND

BACKGROUND OF THE INVENTION

1. Field of the Invention

This invention relates to apparatus for use in exercise of the human body, and in particular, to apparatus for weight-lifting.

2. Description of the Prior Art

It is known in weightlifting that with certain exercises there is a benefit derived from the freedom of the hands to pronate and supinate during the performance of the exercise. For example, when performing single arm curls with dumbbells, it is common for the hand to progress from a pronated position while at the side to a supinated position at the end of the curl.

Cable-actuated weight lifting systems incorporating a handle attachment for actuation by a user of the system are well known in the art. U.S. Pat. No. 5,273,509 to Vittone, for example, discloses an attachment for a cable type system, the attachment resembling handlebars each having a ball connection of the bar to a base for pivoting and swivel of the bar relative to the base. However, the object of the invention in that case was to provide an adjustable grip for comfortable hand positioning of a variety of users. What is needed is an attachment for a cable actuated system allowing for concentrated training of one arm at a time and allowing unrestrained supination and pronation of the hand during single arm exercises such as curls, and reverse curls, approaching that which is capable when using free weights.

It is known in the art to provide barbells with handles allowing for variable hand positions such as U.S. Pat. No. 3,384,370 to Bailey; U.S. Pat. 4,629,184 to Selkee; U.S. Pat.4,690,400 to Metz; and U.S. Pat. No. 4,822,035 to Jennings. These patents disclose a variety of handle connections for two handed barbells which provide for pivot of the handles. However, since these handles are incorporated into the environment of the two handed barbell, the main objective is to provide either adjustable fixed positions or pivoting in order to relieve strain on the wrists. This is due to the fact that the exercises performed using the two handed barbells do not generally involve the large hand rotation associated with those exercises for which the single hand attachment of the present invention is intended.

The Metz '400 patent discloses a modular barbell design in which the handles are housed within ring members which are threadedly engaged to bar members to form a two handed barbell onto which weights are suspended. Although the text of the specification refers to cable attachment of an individual ring member, there is no disclosure in the '400 patent relating to how this is to be accomplished and no claims directed to a cable type system. Additionally, the pivot action of the handle in the Metz invention is provided by a split shoe construction in which the resistance to rotation can be increased. Therefore, the concept of increased resistance to rotation teaches away from the object of the present invention which is the minimization of the resistance to rotation in order to more optimally simulate the supinating and pronating action of single arm free weights. In this regard, it is noted that the construction of the present invention provides annular ring sections which are pivotably connected around their entire circumferences. This more closely simulates the action of a single arm free weight by providing a more smoothly rotating construction as opposed to a construction which is not continuous about the entire circumference.

While the reduced resistance to rotation provided by the present invention more closely simulates the freedom of hand supination and pronation available with free weights, the fact that the attachment is connected to a cable system actually provides certain advantages over the use of free weights. In addition to single arm curl exercises, the user may perform other exercises such as triceps push-downs and reverse triceps push-downs that are not possible with free weights since the resistance available with free weights is limited to gravity forces. Further, since the cable associated with the attachment of the present invention provides the resistance for the exercise, the amount of lifting involved in setting up for the exercise is limited to the weight of the attachment which remains constant. The same exercise using free weights involves lifting of the potentially heavy free weight from the floor or storage position into the position for the exercise. This wasted motion takes away energy which might otherwise be focused on the particular exercise to be performed.

Accordingly, it is an object of the present invention to provide an attachment for a cable-actuated weight-lifting system in which the freedom of the hand of the user to pronate and supinate during the performance of a single arm exercise approaches that which is capable with the use of free weights.

SUMMARY OF THE INVENTION

According to the present invention there is provided an attachment for a cable-actuated weight-lifting system, the attachment including a handle having opposing ends, an inner annular section having an inside surface to which the opposing ends of the handle are attached and an opposite outside surface, an outer section having an inside surface and an opposite outside surface, means in contact with the inside surface of the outer section and the outside surface of the inner section for pivotally supporting the inner section within the outer section, and means extending from the outer section for connecting the attachment to the cable. The means in contact with the inside surface of the outer section may include a bearing assembly.

DESCRIPTION OF THE PREFERRED EMBODIMENTS

Figure 1:
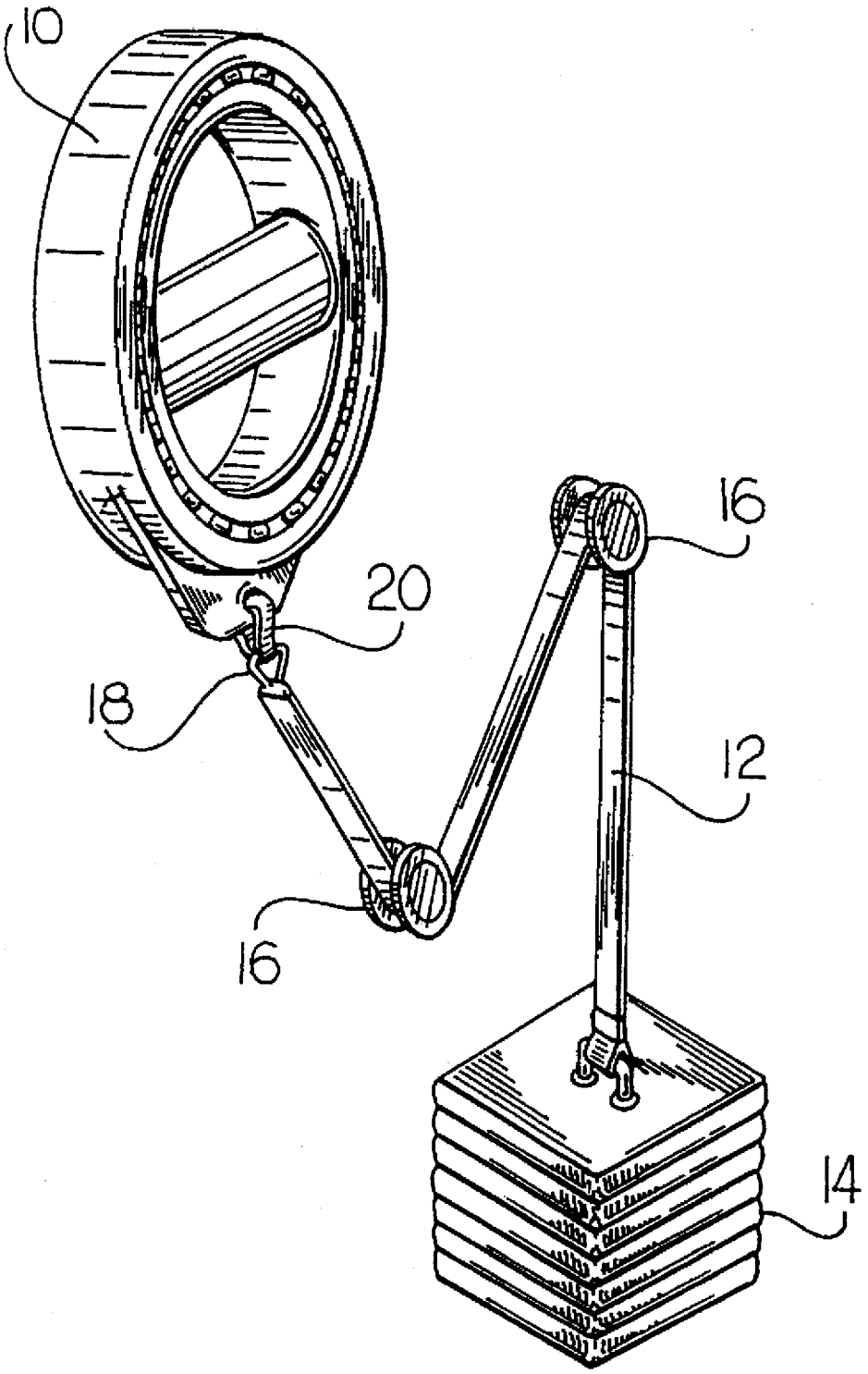
FIG. 1 is a perspective view of an attachment according to the present invention shown connected to a cable-actuated weight-lifting system.

Referring to FIG. 1, an attachment 10 according to the present invention is shown connected to a cable-actuated weight-lifting system. Such a cable system, per se well known in the art, typically will include a length of cable 12 attached at an end to a weight assembly 14 and passing through a number of suitably supported pulleys 16 to an opposite end, shown to have a loop member 18, to which a user will actuate the system through the use of a suitable attachment. FIG. 1 also shows a releasable clip 20 for connecting and disconnecting the attachment 10 to loop member 18 of the cable 12. The attachment of the present invention can be used with any type of cable system including lat machines, cable crossovers, or universal gyms.

Figure 2:
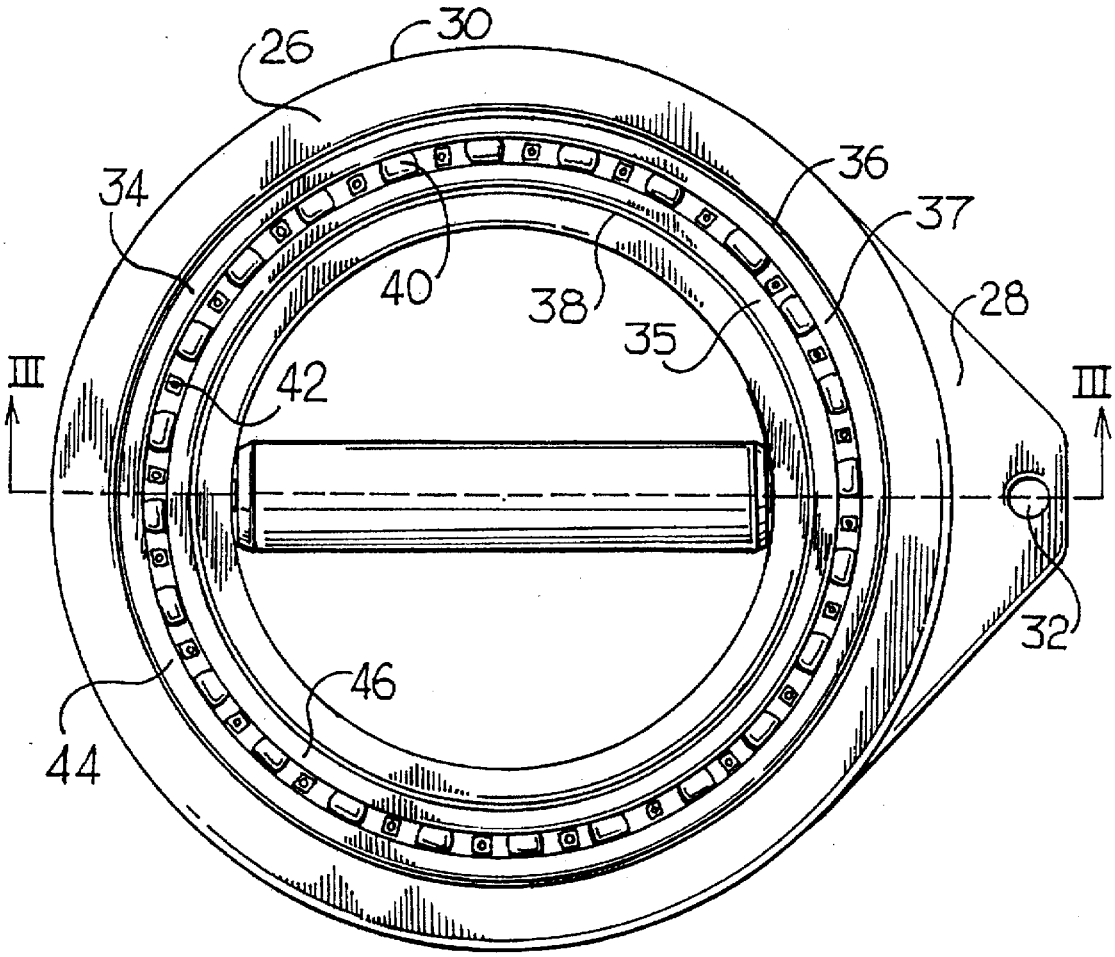
FIG. 2 is an end view of a first embodiment of an attachment according to the present invention.
Figure 3:
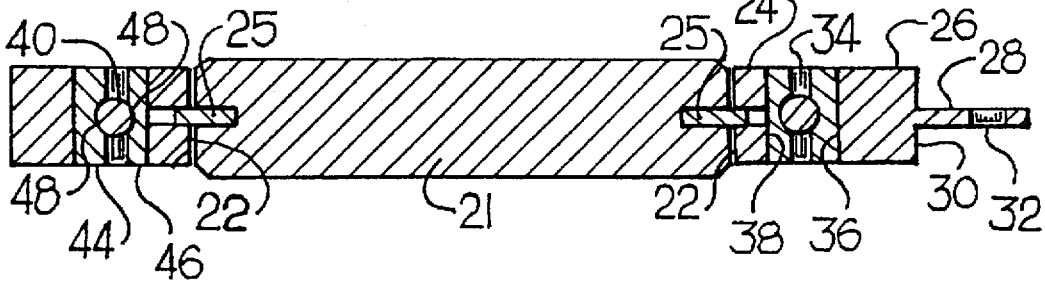
FIG. 3 is a sectional view of the attachment of FIG. 2 taken along lines III—III.

Turning to FIGS. 2 and 3, a first embodiment of an attachment according to the present invention is shown. The attachment includes a handle 21 which is connected at opposite ends to an inside surface 22 of an annular inner section 24. As seen in FIG. 3, the connection of handle 21 to inner section 24 is made through the use of pins 25 which extend from the inside surface of the inner section to an end of the handle. The attachment also includes an outer section 26 which has plate member 28 attached along an outside surface 30. In the preferred embodiment, the outer section and the plate member are metal and the plate member is welded to the outside surface of the outer section. The purpose of plate member 28 is to provide for the connection of the attachment to the cable of the cable-actuated system. As shown in FIG. 1, such connection is made through a clip 20 which passes through a loop member 18 and through an opening 32 in plate member 28.

Figure 3A:
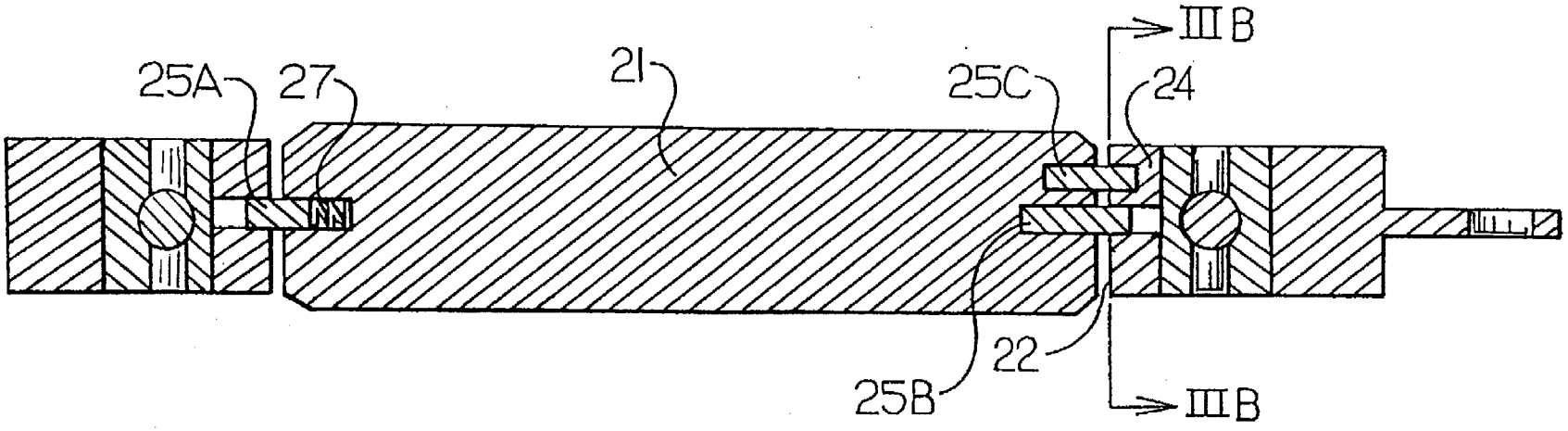
FIG. 3A is a sectional view of an attachment according to the present invention in which the amount of pivot of the handle with respect to the inner section is limited.
Figure 3B:
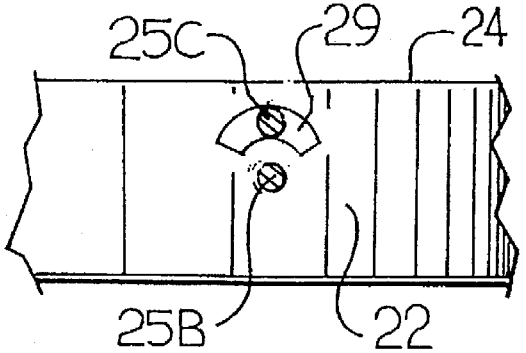
FIG. 3B is a sectional view of the attachment of FIG. 3A showing the arcuate slot and post.
Figure 4:
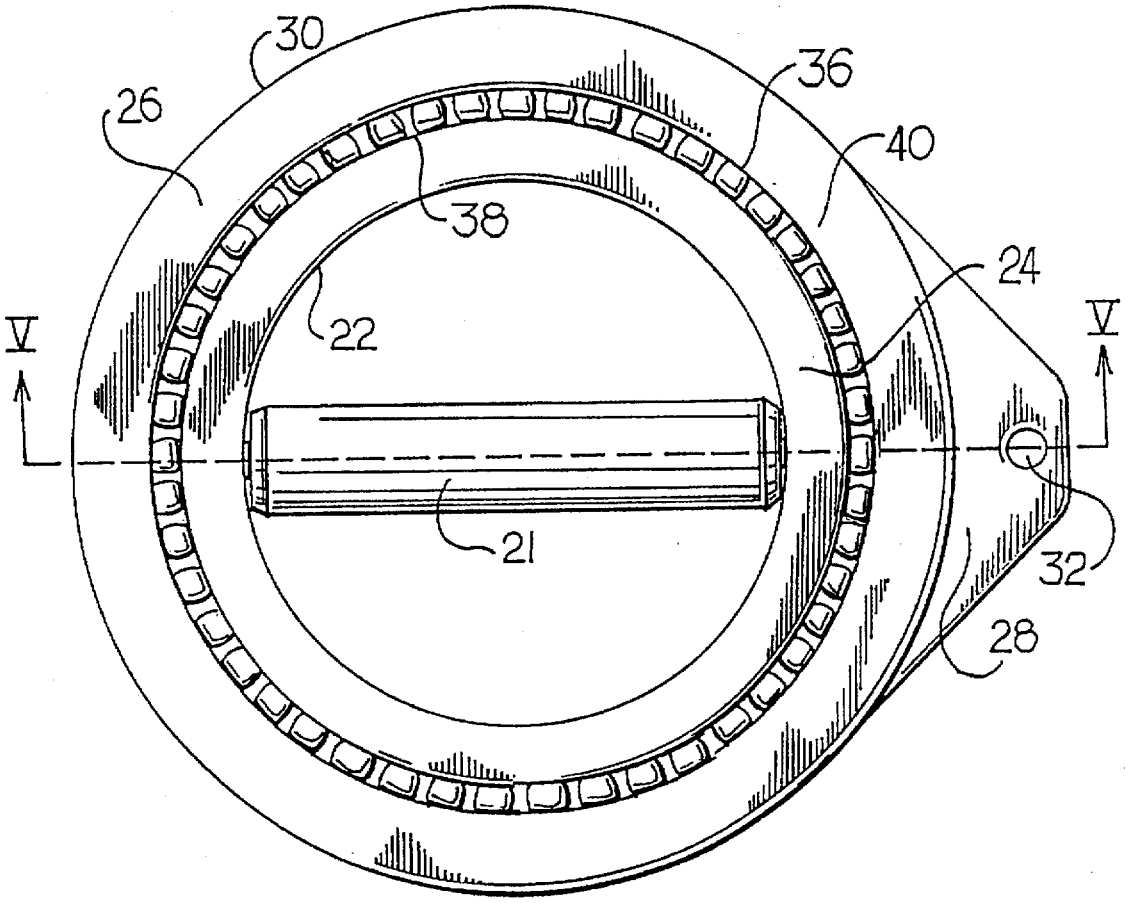
FIG. 4 is an end view of a second embodiment of an attachment according to the present invention.

FIG. 3A shows the cross section of handle 21 in which the amount of the pivot of the handle with respect to the inner section 24 is limited. At one end of handle 21, centrally located pin 25A connects the handle to the inner section. Spring 27 allows for retraction of pin 25A within the associated opening in the handle for installation of the handle. At the opposite end of handle 21, the handle is connected to the inner section through centrally located pin 25B and offset post 25C. As seen in FIG. 3B, an arcuate opening 29 is located on the inside surface 22 of inner section 24 for receiving the offset post 25C. This construction allows for a certain amount of pivot of the handle with respect to the inner section 24 as offset post 25C is free to move within arcuate opening 29 but will provide resistance to further pivot when offset post 25C encounters an end of the arcuate opening 29.

Returning to FIGS. 2 and 3, the combination including the handle 21 and the annular inner section 24 is capable of pivoting relative to the outer section 26. In the preferred embodiment, this pivot is accomplished by the inclusion of a bearing assembly 34 between the inner section and the outer section. The bearing assembly includes an inner segment 35 and an outer segment 37. The inner and outer segments carry opposing grooves 48 which serve as inner and outer races, respectively, in which a plurality of ball bearings 40 are contained, the ball bearings 40 being maintained in a spaced apart relationship by a cage 42. In an attachment according to the present invention, the inner section 24 is free to rotate with respect to the outer section 26, the amount of the potential rotation being unlimited.

Figure 5:
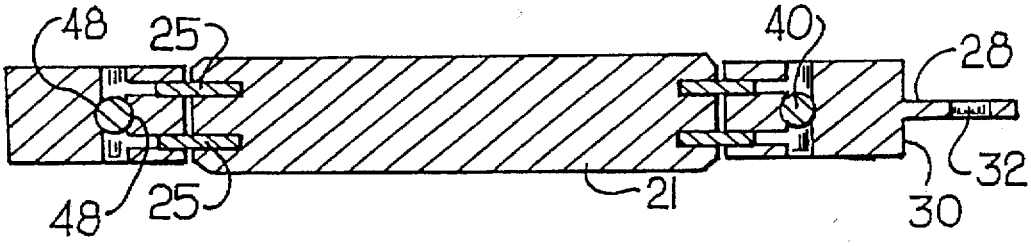
FIG. 5 is a sectional view of the attachment of FIG. 4 taken along lines V—V.

FIGS. 4 through 7 show a second embodiment of the invention which does not incorporate a separate bearing assembly for providing the pivot of the inner section relative to the outer section. Instead, as seen in FIG. 5, the inner and outer sections themselves carry the opposing grooves 48 serving as the inner and outer races, respectively, in which a plurality of ball bearings 40 are contained. Also, there is no cage for maintaining a spaced apart relationship of the ball bearings. As a consequence, this embodiment requires the addition of a sufficient number of ball bearings above that required in the first embodiment to prevent localized groupings, or "pooling", of ball bearings.

Figure 6:
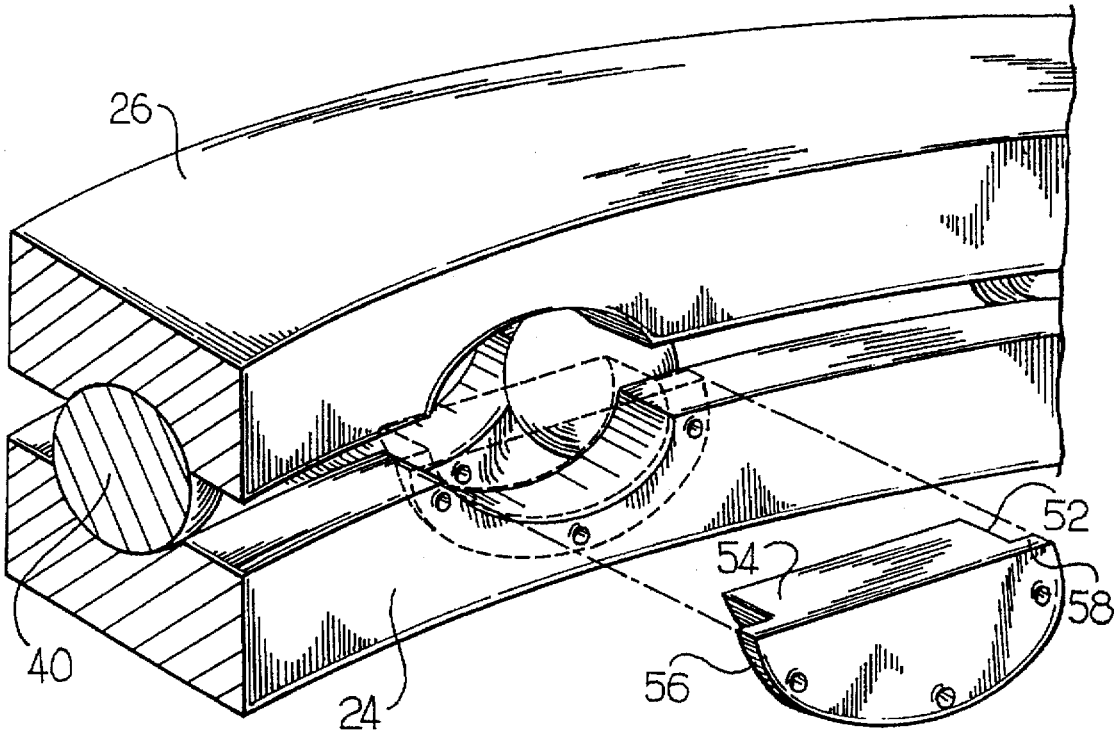
FIG. 6 is a partial perspective view of the attachment of FIG. 4 showing an opening and cover for loading and unloading ball bearings.
Figure 7A:
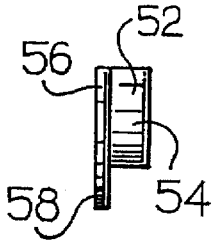
FIG. 7A and 7B are side and front views, respectively, of the cover of FIG. 6.
Figure 7B:
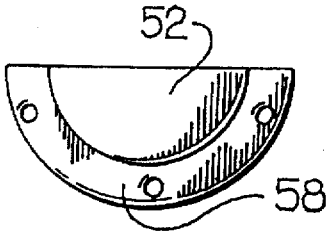

The forming of the ball bearing races directly into the inside surface 36 of the outer section 26 and the outside surface 38 of the inner section 24, as opposed to the inclusion of inner and outer segments of a separate bearing assembly 34, requires that access be provided for loading of ball bearings into the races. FIGS. 6 and 7 show an access opening in each of the inner and outer sections, the openings together providing sufficient clearance for the passage of the ball bearings. A cover 52 which is bolted to the inner section prevents unwanted departure of the ball bearings from within the races. The cover includes an inner portion 54 which is sized for passage within the opening in the inner section and an outer portion 56 having a flange 58 which allows for a bolted connection of the cover to the inner section. Although the cover is shown not to contact the outer section, a suitable cover contacting the outer section as opposed to the inner section is possible, as well as one designed to cover the openings in both the inner and outer sections.

As seen in FIG. 5, each end of the handle 21 is connected to the inner section 24 by two pins 25. Since the groove for the inner race is formed directly in the outside surface 38 of the inner section 24, a single centrally located pin similar to that used in the first embodiment would require that an opening for the pin be formed within the groove forming the inner bearing race. The resulting deformation or discontinuity in the race could pose a detriment to the operation or durability of the bearings. A location for the opening for the pin other than a central location with respect to the handle, however, requires more than a single pin in order to provide balanced support for the handle.

Figure 8A:
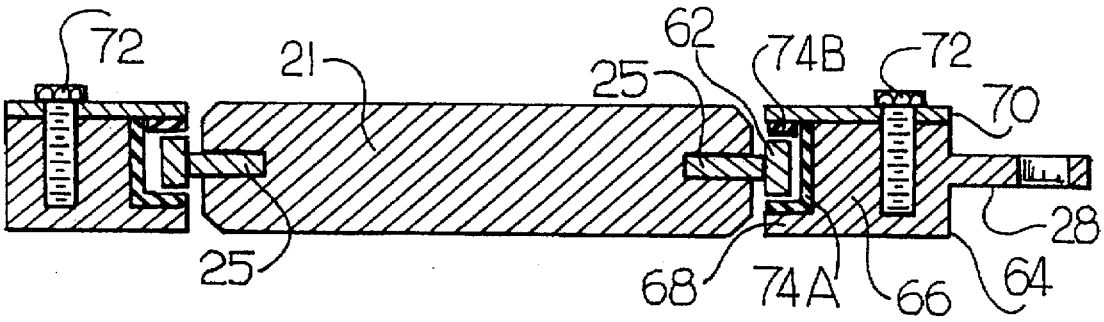
FIG. 8A is sectional view of an attachment according to the present invention utilizing a low coefficient of friction material in place of the bearing assemblies.
Figure 8B:
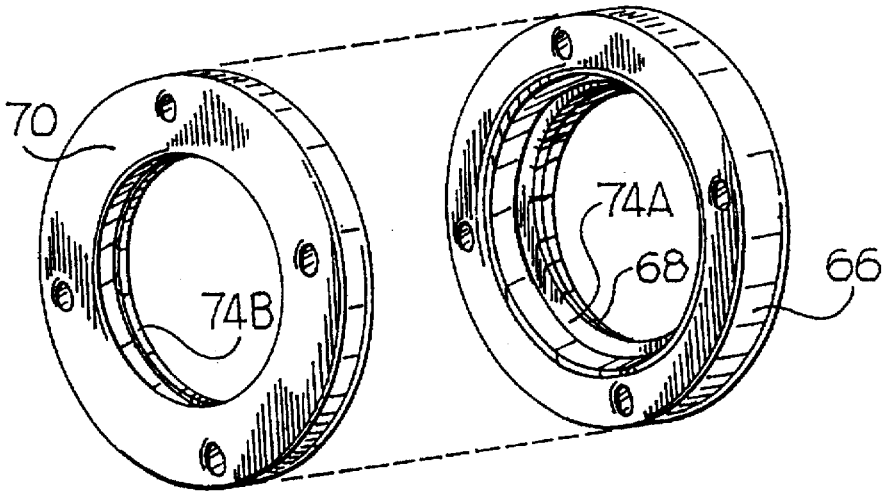
FIG. 8B is an exploded perspective view of the outer section of the attachment of FIG. 8A.

The attachment shown in FIG. 8A utilizes an alternative construction to the bearing constructions of the previously described attachments. Similar to the attachments of the previous figures, the attachment of FIG. 8A includes a handle 21 which is attached to an annular inner section 62 through pins 25 extending between the opposing ends of the handle and the inside surface of the inner section 62. The inner section 62 is somewhat smaller in width than inner section 24 of the prior figures to allow for partial envelopment of the inner section by the outer section within roughly the same overall thickness. The outer section 64 is annular and includes a main body 66 having ledge 68 formed along its inside surface. The outer section 64 also includes a cover plate 70 which is attached to the main body 66 through bolts 72. The inside surface of the main body 66 together with the projecting portion of the cover plate 70 form a channel shape cross section for partially enveloping the inner section 62 with respect to three of its surfaces as seen in FIG. 8A. The inside surface of the main body 66 and the projecting portion of the cover plate 70 include layer, 74A and 74B, respectively, which consists of a material having a sufficiently low frictional coefficient, a polytetrafluoroethylene for example, to allow for sliding contact between the outside surface of the inner section 62 and the channel shaped inner surface of the outer section 64. The polytetrafluoroethylene coating will allow for relatively unrestricted movement of the inner section with respect to the outer section, and is included to replace the function provided in the previously described embodiments by the bearing constructions. Although the layer of the low frictional coefficient material is shown formed on the channel shaped portion of the outer section 64, the use of a layer of such material formed on the surfaces of the inner section 62 which are enveloped by the outer section would also function to facilitate the sliding contact between the inner and outer sections of the attachment of the present invention.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An attachment for facilitating single-handed exercise in a cable-actuated weight-lifting system, the attachment consisting essentially of:

(a) a handle having opposed ends;

(b) an inner annular section having an inside surface to which the opposing ends of said handle are attached and an opposite outside surface;

(c) an outer section having an inside surface and an opposite outside surface;

(d) means in contact with the inside surface of said outer section and the outside surface of said inner section for rotatably supporting said inner section within said outer section; and (e) means extending from said outside surface of said outer section for directly connecting to an end of such a cable.

2. The attachment according to claim 1 wherein said means for pivotally supporting includes a bearing assembly having an outside surface attached to said outer section and an opposite inside surface attached to said inner section.

3. The attachment according to claim 2 wherein said bearing assembly includes a plurality of ball bearings and a cage which maintains the ball bearings in a spaced apart relationship, the bearing assembly further includes a pair of races which confront each other on opposing sides of said ball bearings.

4. The attachment according to claim 2 wherein said handle is attached to said inner section by at least one pin extending between each of the ends of said handle and the inside surface of said inner section for pivoting of the handle about the a central axis of the handle relative to the inner section.

5. The attachment according to claim 1 wherein the inside surface of said outer section and the outside surface of said inner section have grooves which confront each other and wherein said means for pivotally supporting includes a plurality of closely spaced ball bearings located between said inner and outer section and contacting said grooves.

6. The attachment according to claim 5 wherein said inner section and said outer section have opposing openings for loading and unloading of said ball bearings and wherein said attachment further includes a cover member attached to at least one of either of said inner section and said outer section, said cover overlying at least a portion of said opposing openings such that the ball bearings are prevented from passing through the opposing openings.

7. The attachment according to claim 5 wherein said handle is attached to said inner section by at least two pins extending between each of the ends of said handle and the inside of said inner section, the two pins at each end of the handle being remotely located with respect to the groove for avoiding deformation or discontinuity to the groove in the inner section.

8. The attachment according to claim 1 wherein said means for connecting includes a plate member extending from the outside surface of said outer section, said plate member having an opening for connection of the attachment to such cable.

9. The attachment according to claim 8 wherein said means for connecting further includes a clip extending through said opening for connection of the attachment to such a cable.

10. The attachment according to claim 1 wherein each of the opposing ends of the handle is connected to the inner section by at least one pin extending between confronting openings in the handle and the inner section for pivoting of the handle about a central axis of the handle relative to the inner section.

11. The attachment according to claim 10 wherein said pins are located substantially at a central axis of the handle and wherein the handle further includes an offset post extending between confronting openings in the handle and the inner section at a location other than the central axis of the handle, the opening in the inner section having an arcuate shape such that pivot of the handle about the central axis is limited by contact of the offset post with an edge of said arcuate opening.

12. The attachment according to claim 1, wherein the inside surface of the outer section includes an annular opening for enveloping the outside surface of the inner section and wherein at least one of the inner section and the outer section includes a substantially frictionless layer carried on at least a portion of its surface adjacent the annular opening such that sliding contact between the inner section and the outer section is enabled.

13. The attachment according to claim 12, wherein the substantially frictionless layer is polytetrafluoroethylene.

14. The attachment according to claim 12, wherein the substantially frictionless layer is carried on the outer section.

* * * * *